US012806493B2

(12) United States Patent
Kurachi et al.

(10) Patent No.: US 12,806,493 B2
(45) Date of Patent: Nov. 24, 2026

(54) MARK FOR CLUB HEAD MEASUREMENT AND IMAGE PROCESSING DEVICE

(71) Applicant: AMPLUS Co., Ltd., Yokohama (JP)

(72) Inventors: Nobuhisa Kurachi, Yokohama (JP); Kazushige Karasawa, Yokohama (JP); Daisuke Saito, Yokohama (JP)

(73) Assignee: AMPLUS Co., Ltd., Yokohama (JP)

( * ) Notice: Subject to any disclaimer, the term of this patent is extended or adjusted under 35 U.S.C. 154(b) by 455 days.

(21) Appl. No.: 18/373,693

(22) Filed: Sep. 27, 2023

(65) Prior Publication Data

US 2024/0017142 A1 Jan. 18, 2024

Related U.S. Application Data

(62) Division of application No. 17/508,488, filed on Oct. 22, 2021, now abandoned.

(30) Foreign Application Priority Data

Jan. 21, 2021 (JP) ..... 2021-007703

(51) Int. Cl.
*A63B 60/42* (2015.01)
*A63B 24/00* (2006.01)
(Continued)

(52) U.S. Cl.
CPC ..... *A63B 60/42* (2015.10); *A63B 24/0003* (2013.01); *A63B 53/04* (2013.01);
(Continued)

(58) Field of Classification Search
CPC ..... A36B 60/42; A36B 24/0003; A36B 53/04; A36B 71/0622; A36B 2071/0674;
(Continued)

(56) References Cited

U.S. PATENT DOCUMENTS 1,526,951 A 2/1925 Green
3,548,504 A 12/1970 Sykes
(Continued)

FOREIGN PATENT DOCUMENTS

JP 2005-087615 A 4/2005
JP 2015-083961 A 4/2015
JP 2018-061729 A 4/2018

OTHER PUBLICATIONS

Japanese Office Action, dated Jun. 21, 2021, in Japanese Application No. 2021-007703 and English Translation of thereof.
(Continued)

*Primary Examiner* — Stephen R Koziol
*Assistant Examiner* — Michael Kim Maiden
(74) *Attorney, Agent, or Firm* — McGinn IP Law Group, PLLC

(57) ABSTRACT

An image processing device for use with a mark for club head measurement in use for measuring information about a state of a club head of a golf club, the mark being provided on the club head, the image processing device including a mark detector configured to acquire time-series photographic images in which the club head is photographed when the golf club having the club head with the club head for club head measurement is swung, and to detect the mark for club head measurement from each of the photographic images; and a head information generator configured to generate information about a state of the club head, based on the mark for club head measurement detected by the mark detector.

6 Claims, 13 Drawing Sheets

(51) Int. Cl.
*A63B 53/04* (2015.01)
*A63B 71/06* (2006.01)

(52) U.S. Cl.
CPC .. *A63B 71/0622* (2013.01); *A63B 2071/0647* (2013.01); *A63B 2220/05* (2013.01); *A63B 2220/807* (2013.01); *A63B 2225/74* (2020.08)

(58) Field of Classification Search
CPC ..... A36B 2220/05; A36B 2220/807; A36B 2225/74; G06V 10/25; G06V 10/255; G06V 10/44; G06V 10/62; G06T 2207/30208; G06T 2207/30221; G06T 2207/30241; G06T 7/20
See application file for complete search history.

(56) References Cited

U.S. PATENT DOCUMENTS 3,884,477 A 5/1975 Bianco
4,340,229 A 7/1982 Stuff, Jr.
6,699,139 B2 3/2004 Kim
7,388,969 B2 6/2008 Miki
D620,993 S 8/2010 Laub
D722,350 S 2/2015 Schweigert
9,094,615 B2 7/2015 Aman
9,895,585 B2 2/2018 Kroloff
10,074,171 B1 9/2018 Maurer
2003/0036438 A1 2/2003 Tang
2005/0187028 A1 8/2005 Chang
2006/0068928 A1 3/2006 Nagy
2007/0004524 A1 1/2007 Harrison
2007/0213140 A1 9/2007 Miller
2009/0054172 A1 2/2009 Meehan
2009/0270204 A1* 10/2009 Saegusa ..... A63B 69/3614 473/409
2010/0210377 A1* 8/2010 Lock ..... A63B 69/3658 473/409
2012/0214606 A1* 8/2012 Ueda ..... A63B 69/3614 473/409
2020/0197779 A1* 6/2020 Hauge ..... A63B 69/3685
2021/0133987 A1* 5/2021 Suzuki ..... G06T 7/70

OTHER PUBLICATIONS

United States Office Action dated Sep. 22, 2023 in U.S. Appl. No. 17/508,488.

* cited by examiner

MARK FOR CLUB HEAD MEASUREMENT AND IMAGE PROCESSING DEVICE

CROSS-REFERENCE TO RELATED APPLICATIONS

The present application is a Divisional Application of U.S. patent application Ser. No. 17/508,488, filed on Oct. 22, 2021, the entire contents of which are hereby incorporated by reference. This application is based upon and claims priority under 35 U.S.C. § 119 from Japanese Patent Application No. 2021-007703, filed on Jan. 21, 2021, the entire contents of which are incorporated herein by reference.

BACKGROUND OF THE INVENTION

1. Field of the Invention

The present invention is related to a mark for club head measurement in use for measuring information about a state of a club head of a golf club and an image processing device that detects the mark for club head measurement from a photographic image thereof.

2. Description of the Related Art

Conventionally, a variety of devices that take photos of a golfer's swing and provide photographic information thereof have been proposed. The photographic information of the swing is provided to the golfer to encourage the golfer to improve golfing or encourage the golfer to select a golf club suitable for the golfer.

As an example of the device described above, Japanese Patent Application Laid-open No. 2018-61729 proposes photographing a golf club and a golf ball from above when a golfer swings the golf club, and projecting a full-size image of the photographed club head and golf ball on the floor.

SUMMARY OF THE INVENTION

Here, important factors of a golfer's swing include the motion of the face of a club head and the velocity of a club head during a swing. Recognizing the motion of the face of the club head or the velocity of the club head during a swing enables understanding of the characteristics of the golfer's swing and enables selection of a golf club suited to the characteristics.

However, when a club head in motion is simply photographed from above, for example, as in Japanese Patent Application Laid-open No. 2018-61729, it is difficult to detect the position or the face of the club head from the photographic image with high accuracy, and it is difficult to obtain information about a state of the club head, such as the velocity of the club head or the motion of the face, with high accuracy.

In view of the aforementioned problem, an object of the present invention is to provide a mark for club head measurement and an image processing device that can obtain information about a state of a club head with high accuracy.

A mark for club head measurement of the present invention is used to measure information about a state of a club head of a golf club and is provided on the club head. The mark includes a central portion formed with a pattern having a lightness lower than the periphery thereof and a peripheral portion formed with a pattern surrounding the periphery of the central portion and having a lightness higher than that of the central portion.

In the mark for club head measurement of the present invention, the central portion may be circular, and the peripheral portion may have a doughnut shape, and it is preferable for the peripheral portion to have a width smaller than a radius of the central portion.

In the mark for club head measurement of the present invention, it is preferable for a maximum brightness value of the central portion to be 32 or less, and a difference between the maximum brightness value and for a minimum brightness value of the central portion to be 15 or less.

In the mark for club head measurement of the present invention, two doughnut-shaped marks each including the central portion and the peripheral portion may be arranged side by side and formed integrally.

In the mark for club head measurement of the present invention, it is preferable for the mark to be a sticker on which glue is applied to enable the mark to be affixed to the club head.

A first image processing device of the present invention includes: a mark detector configured to acquire time-series photographic images in which a club head is photographed when a golf club having a club head with the mark for club head measurement is swung, and to detect the mark for club head measurement from each of the photographic images; and a head information generator configured to generate information about a state of the club head, based on the mark for club head measurement detected by the mark detector.

In the first image processing device of the present invention, when the number of the marks for club head measurement detected from a certain photographic image of the photographic images is larger than a preset number, the mark detector specifies the mark for club head measurement included in the certain photographic image, based on information on the mark for club head measurement in another photographic image in which the preset number of the marks for club head measurement are detected.

In the first image processing device of the present invention, the head information generator may generate a trajectory image representing a trajectory of the club head of the golf club and a group of a plurality of face images each representing a face of the club head during the swing, as the information about a state of the club head, and the image processing device may include a control unit configured to display the trajectory image and the group of face images.

A second image processing device of the present invention includes: an image generating unit configured to generate a trajectory image representing a trajectory of a club head of a golf club during a swing of the golf club and a group of a plurality of face images each representing a face of the club head during the swing; and a control unit configured to display the trajectory image and the group of face images.

In the second image processing device of the present invention, the image generating unit may generate an image representing the face by a straight line, as each of the face images.

According to the mark for club head measurement and the first image processing device of the present invention, the mark includes a central portion formed with a pattern having a lightness lower than the periphery and a peripheral portion formed with a pattern having a lightness higher than the central portion, so that information about a state of a club head can be obtained with high accuracy.

According to the second image processing device of the present invention, a trajectory image representing a trajectory of a club head of a golf club during a swing of the golf club and a group of a plurality of face images each representing a face of the club head during the swing are generated, and the trajectory image and the group of face images are displayed, so that the trajectory of the club head and the motion of the face can be understood more clearly.

DETAILED DESCRIPTION OF THE INVENTION

Figure 1:
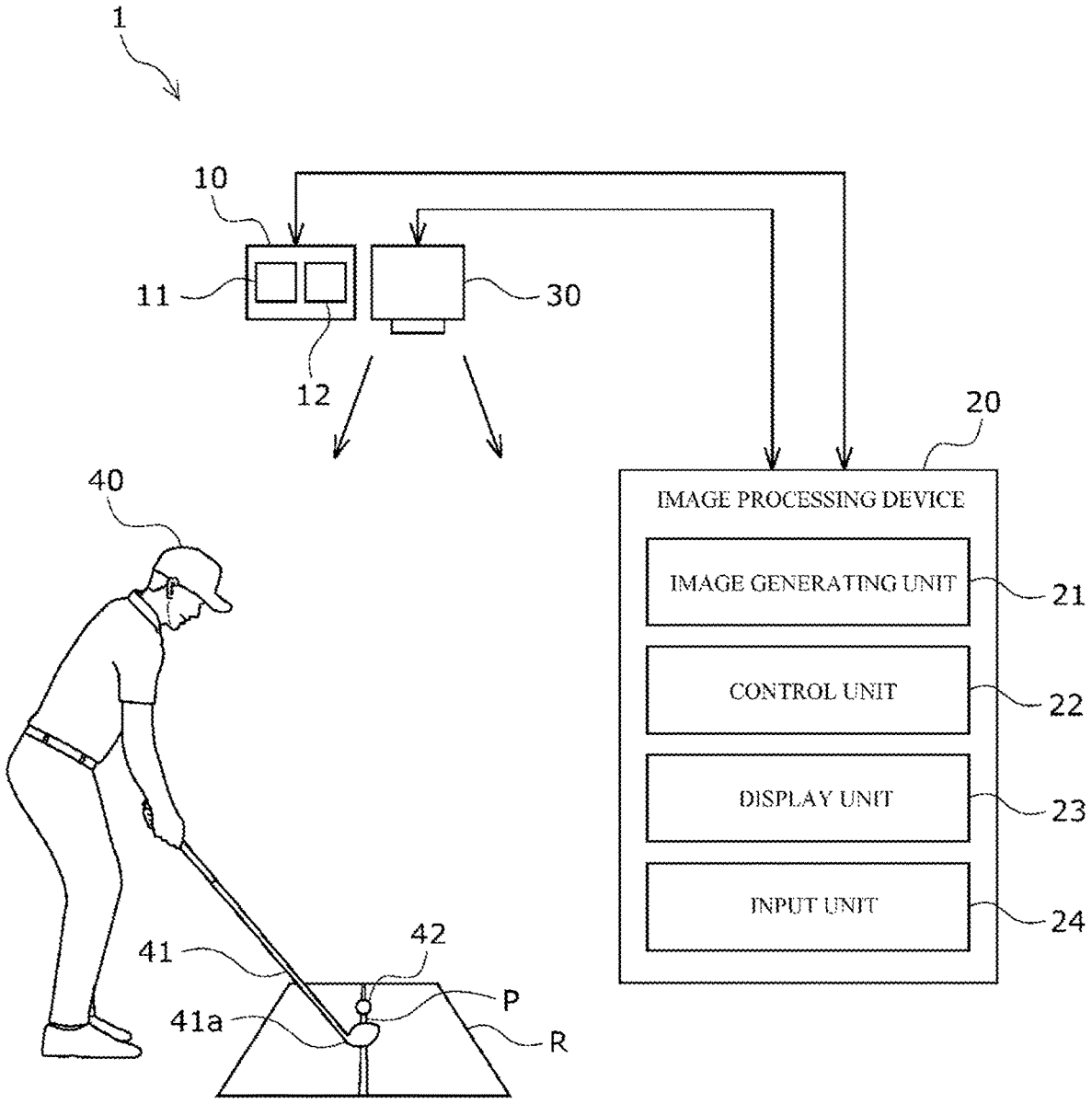
FIG. 1 is a diagram illustrating an overall configuration of a golf impact analysis system including an embodiment of an image processing device of the present invention.

A golf impact analysis system including an embodiment of a mark for club head measurement and an image processing device of the present invention will be described in detail below with reference to the drawings. The golf impact analysis system of the present embodiment is characterized by a mark for club head measurement for measuring information about a state of a club head. First, the overall golf impact analysis system will be described. FIG. 1 is an overall configuration diagram of a golf impact analysis system 1 of the present embodiment.

As illustrated in FIG. 1, the golf impact analysis system 1 of the present embodiment includes a photography device 10, an image processing device 20, and a projection device 30. The photography device 10 and the image processing device 20 as well as the image processing device 20 and the projection device 30 are communicatively connected by wire or wirelessly so that a variety of signals can be exchanged.

The photography device 10 takes a photograph of a club head 41*a* of a golf club 41 from above when a golfer 40 swings the golf club 41. The photography device 10 is installed above the golfer 40 who swings the golf club 41 and is installed immediately above a region in which the club head 41*a* passes through the vicinity of a floor so that the region can be photographed. Specifically, the photography device 10 may be installed immediately above a predetermined photography region R including the vicinity around a preset placement position P of a golf ball 42 on the floor, for example. The photography device 10 may be installed on a support member such as a stand or may be installed on a ceiling.

The photography device 10 includes an illumination unit 11 and a camera unit 12. The illumination unit 11 of the present embodiment has an infrared light source and irradiates the photography region R with infrared light emitted from the infrared light source. The camera unit 12 has an image pickup element, such as a complementary metal-oxide-semiconductor (CMOS) image sensor or a charge-coupled device (CCD) image sensor, and an IR filter arranged in front of the image pickup element. The IR filter is an optical filter that absorbs visible light and transmits infrared light.

The photography device 10 emits infrared light from the illumination unit 11 and takes a photograph in the photography region R with the camera unit 12, based on a control signal output from a control unit 22 of the image processing device 20 to be described later. Specifically, the photography device 10 emits infrared light from the illumination unit 11 at a predetermined frame rate and takes photographs of the club head 41*a* passing through the photography region R. Photographic images taken by the photography device 10 at a predetermined frame rate are output to the image processing device 20.

The image processing device 20 is configured with, for example, a computer and includes a central processing unit (CPU), a semiconductor memory such as a read-only memory (ROM) and a random access memory (RAM), a storage such as a hard disk, and hardware such as a communication UF.

The image processing device 20 includes an image generating unit 21, a control unit 22, a display unit 23, and an input unit 24.

A golf impact analysis program is installed in the semiconductor memory or the hard disk of the image processing device 20. This program is executed by the CPU to enable the image generating unit 21 and the control unit 22 described above to function. In the present embodiment, all of the functions described above are implemented by the golf impact analysis program. However, the present invention is not limited thereto, and some or all of the functions may be configured with hardware such as an application-specific integrated circuit (ASIC), a field-programmable gate array (FPGA), or any other electric circuit.

The components of the image processing device 20 will be described in detail below.

The image generating unit 21 acquires a plurality of time-series photographic images of the club head 41*a* taken by the photography device 10 and generates a group of face images each representing the face of the club head 41*a*, based on the acquired photographic images. The term "face" used throughout the present specification refers to a surface in the club head 41*a* that impacts a golf ball. The image generating unit 21 of the present embodiment corresponds to the mark detector and the head information generator of the present invention.

Figure 2:
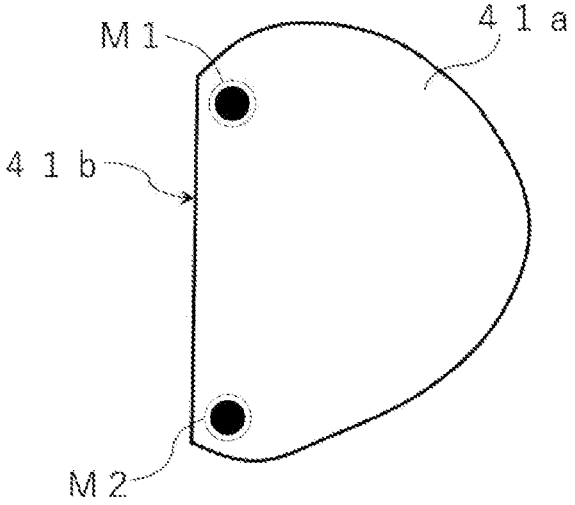
FIG. 2 is a diagram illustrating an example of doughnut-shaped marks provided on a club head.

Specifically, as illustrated in FIG. 2, the top surface of the club head 41*a* of the golf club 41 swung by the golfer 40 has two doughnut-shaped (double circle-shaped) marks M1 and M2 serving as indicators of the face 41*b*. The doughnut-shaped marks M1 and M2 correspond to the mark for club head measurement of the present invention.

The doughnut-shaped marks M1 and M2 are stickers on which glue is applied so that the doughnut-shaped marks M1 and M2 can be affixed to the club head 41*a*. The doughnut-shaped marks M1 and M2 are affixed to the top surface of the club head 41*a* at a predetermined distance from each other along the face 41*b*.

Figure 3:
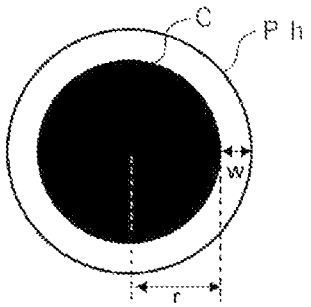
FIG. 3 is a diagram illustrating the details of the doughnut-shaped marks.

As illustrated in FIG. 3, the doughnut-shaped marks M1 and M2 each include a central portion C formed with a pattern having a lightness lower than the periphery and a peripheral portion Ph formed with a pattern surrounding the periphery of the central portion C having a lightness higher than the central portion C.

In the present embodiment, the doughnut-shaped marks M1 and M2 each have the central portion C formed with a circular pattern and the peripheral portion Ph formed in a doughnut shape. The central portion C is filled black, and the peripheral portion Ph is white.

The doughnut-shaped marks M1 and M2 of the present embodiment are each formed such that the width w of the peripheral portion Ph is smaller than the radius r of the central portion C. The width w of the peripheral portion Ph is preferably less than or equal to half the radius r of the central portion C, and more preferably less than or equal to one third the radius r. Specifically, for example, the width w of the peripheral portion Ph may be 1.5 mm, and the radius r of the central portion C may be 4.5 mm.

The reason why the width w of the peripheral portion Ph is smaller than the radius r of the central portion C in this manner is that if the width w of the peripheral portion Ph is larger, the image of the peripheral portion Ph in a photographic image taken by the photography device 10 will exhibit blown-out highlights, which may influence the accuracy of detection of the central portion C.

In the present embodiment, making the width w of the peripheral portion Ph smaller than the radius r of the central portion C can suppress the influence of the blown-out highlights described above and can improve the accuracy of detection of the central portion C.

As described above, the central portion C is formed to be black. When a photograph is taken by the photography device 10, infrared light is reflected at the central portion C even if it is formed to be black, depending on the material thereof or the like, imparting an influence on the accuracy of detection of the central portion C. It is therefore preferable for the material of the central portion C to be selected such that the maximum brightness value of the photographic image of the central portion C is 32 or less and the difference between the maximum brightness value and the minimum brightness value is 15 or less. Each pixel of the photographic image is eight bits (256 gray levels), and the brightness value is a value from 0 to 255. The measurement conditions of the brightness value will be described later in examples and comparative examples.

Selecting the material of the central portion C such that the brightness value falls within the range described above can suppress reflection of infrared light at the central portion C and can improve the accuracy of detection of the central portion C.

The image generating unit 21 detects the doughnut-shaped marks M1 and M2 described above from each of the time-series photographic images. Then, the image generating unit 21 generates a face image that represents the face 41*b* by a straight line by connecting the center of the central portion C of the doughnut-shaped mark M1 and the center of the central portion C of the doughnut-shaped mark M2 with a straight line.

Figure 4:
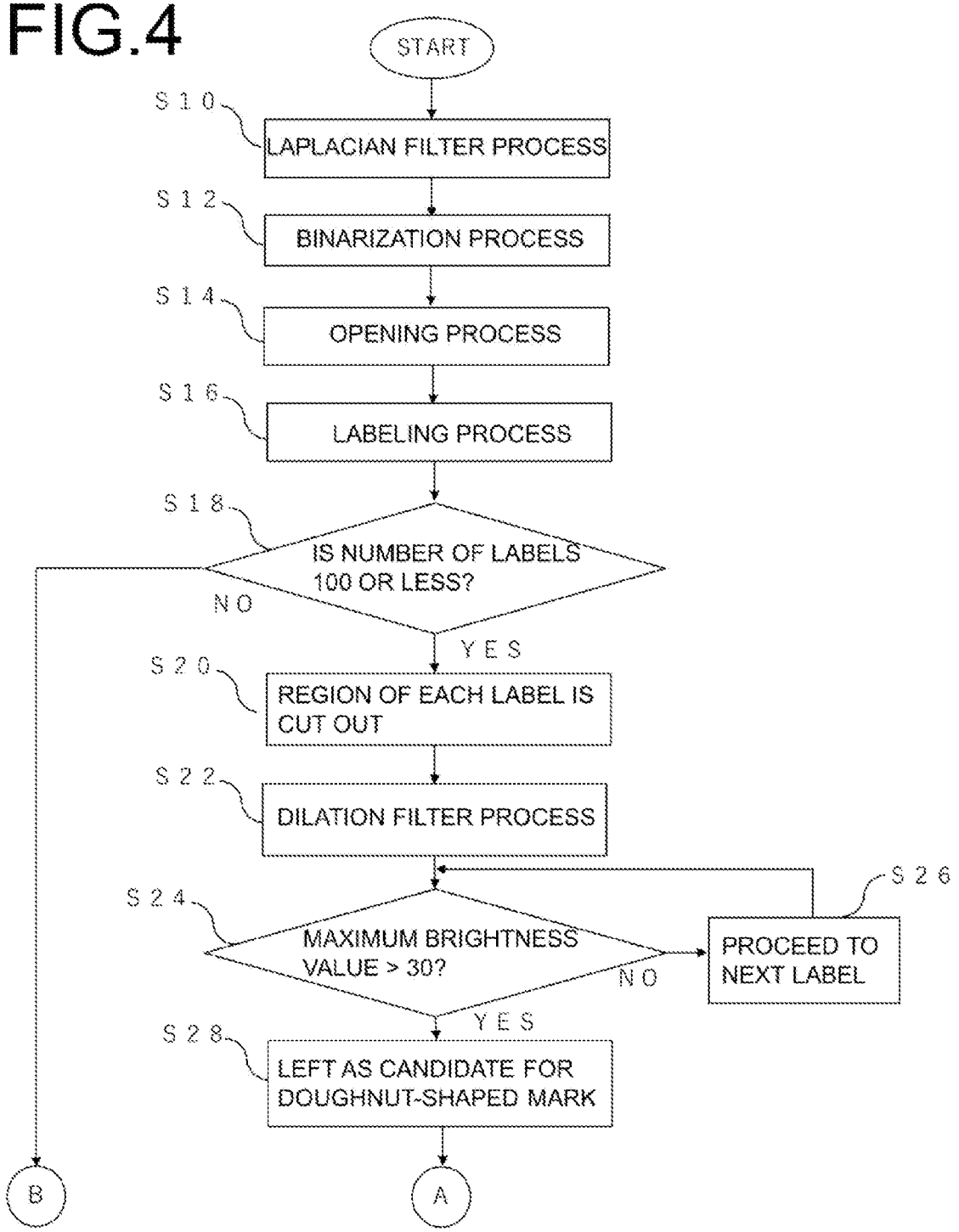
FIG. 4 is a flowchart illustrating an exemplary method of detecting the doughnut-shaped marks from a photographic image.
Figure 5:
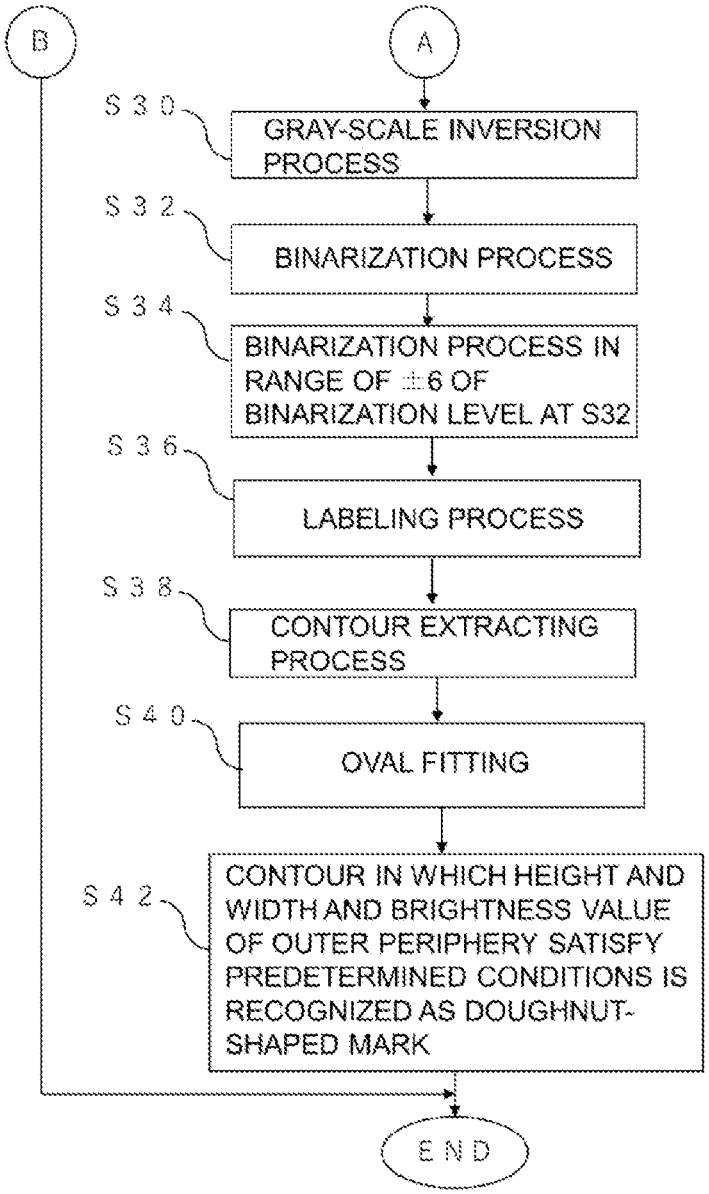
FIG. 5 is a flowchart illustrating an exemplary method of detecting the doughnut-shaped marks from a photographic image.

Here, a method of detecting the doughnut-shaped marks M1 and M2 from a photographic image will be described with reference to the flowchart illustrated in FIG. 4 and FIG. 5.

Figure 6:
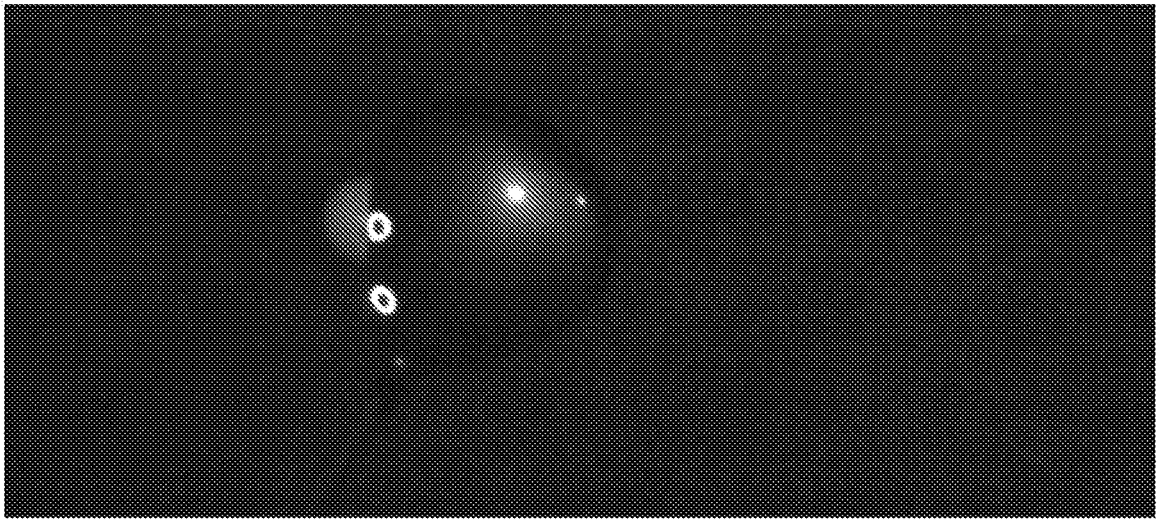
FIG. 6 is a diagram illustrating an example of the photographic image before a Laplacian filter process.
Figure 7:
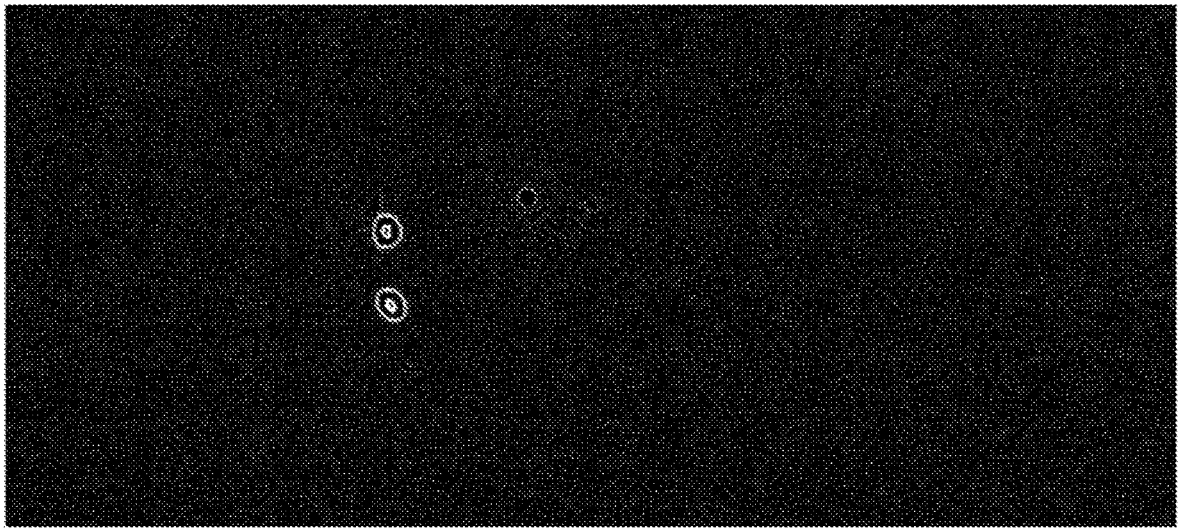
FIG. 7 is a diagram illustrating an example of the photographic image after the Laplacian filter process.

First, an edge enhancement process is performed by performing a Laplacian filter process on the photographic image (S10). For example, a 3×3 filter is used as a Laplacian filter. FIG. 6 is a diagram illustrating an example of the photographic image before the Laplacian filter process, and FIG. 7 is a diagram illustrating an example of the photographic image after the Laplacian filter process. As illustrated in FIG. 6, in addition to the doughnut-shaped marks M1 and M2, a reflection image of the golf ball and a bright spot that is considered to be a reflection by the club head 41*a* are included in the photographic image, but can be caused to fade by performing the Laplacian filter process described above, so that erroneous detection of the doughnut-shaped marks M1 and M2 can be reduced.

A binarization process is then performed on the photographic image which was subjected to the Laplacian filter process (S12). As the binarization process, for example, a binarization process by the discrimination analysis method (Otsu's method) is performed.

Subsequently, an opening process is performed on the photographic image which was subjected to the binarization process (S14). This process removes small patterns or fine patterns other than the doughnut-shaped marks M1 and M2 and makes the doughnut-shaped marks M1 and M2 more distinctive.

Subsequently, a labeling process is performed on the photographic image which was subjected to the opening process (S16).

If the number of labels generated by the labeling process is 100 or more (NO at S18), it is determined that the doughnut-shaped marks M1 and M2 are not detected appropriately, and the process ends.

On the other hand, if the number of labels is less than 100 (YES at S18), a region three times the area of each label is defined, and a photographic image included in the region (a part of the photographic image illustrated in FIG. 6) is cut out (S20).

Then, a 2×2 dilation filter process is performed on the images cut out at S20 (hereinafter referred to as cut-out images) (S22). The cut-out images include a white portion that is the peripheral portion Ph of the doughnut-shaped marks M1, M2, but the detected white portion may be discontinuous at some points. Performing the dilation filter process described above on the cut-out images can eliminate the discontinuation described above and improve the accuracy of detection of the peripheral portion Ph.

Then, after the dilation filter process is performed on the cut-out images described above, if the maximum brightness value of the cut-out image corresponding to a predetermined label is 30 or less (NO at S22), the process proceeds to the cut-out image corresponding to the next label, and if the maximum brightness value exceeds 30 (YES at S22), the cut-out image corresponding to the predetermined label is possibly the doughnut-shaped marks M1, M2 and is left as a candidate for the doughnut-shaped marks M1, M2 (S28). The cut-out image having the maximum brightness value of 30 or less is not left as a candidate for the doughnut-shaped marks M1, M2 and is not subjected to the following process.

Figure 8:
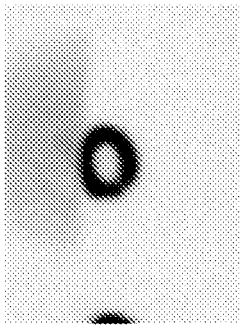
FIG. 8 is a diagram illustrating an example of a cut-out image after a gray-scale inversion process.

Subsequently, a gray-scale inversion process is performed on the cut-out image left as a candidate for the doughnut-shaped marks M1, M2 among the cut-out images cut out at S20 (S30). FIG. 8 is a diagram illustrating an example of the cut-out image subjected to the gray-scale inversion process.

Then, a binarization process is performed on the cut-out image which was subjected to the gray-scale inversion process (S32). As the binarization process, for example, a binarization process by the discrimination analysis method (Otsu's method) is performed.

Figure 9:
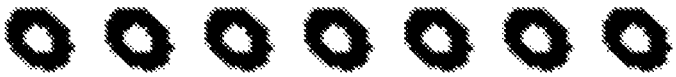
FIG. 9 is a diagram illustrating an example of a binarization process result when a binarization level (threshold) is varied in a range of ±6.

Subsequently, the binarization process is performed again by changing the binarization level at two-pitch intervals in the range of ±6 around the binarization level (threshold) used in the binarization process at S32 (S34). This process generates seven binarized images as illustrated in FIG. 9 for one cut-out image. Then, a white portion of the binarized image is masked and labeling is performed again (S36).

Subsequently, the contour of the label closest to the center of each binarized image is extracted (S38). Then, an oval is fitted to the contour extracted at S38 (S40). Then, the median of the areas of the ovals extracted for seven binarized images is determined, and the mean values of height and width are determined for the oval having the median, the ovals having up to the second largest value from the median value, and the ovals having up to the second smallest value from the median value, that is, five ovals excluding the oval having the largest area and the oval having the smallest area among the seven extracted ovals. The height and the width of an oval mean that the height is the length in the y direction and the width is the length in the x direction when the coordinates system of the photographic image is two-dimensional coordinates of x and y.

When the mean height and width of an oval is within a preset range of thresholds and the brightness value of a portion in the cut-out image corresponding to the oval is 100 or greater, the contour thereof is recognized as the doughnut-shaped marks M1, M2 (S42).

The above-described steps S10 to S42 are performed on each photographic image to detect the doughnut-shaped marks M1 and M2 included in each photographic image.

Here, if a mark having a uniform simple circle, dot, or line in the same color are attached to the club head 41*a* instead of the doughnut-shaped marks M1 and M2 as in the present embodiment, for example, the binarization determination process is adversely affected when position recognition of the mark on a black and white image is performed using mechanical image processing. Specifically, reflection light caused by near-infrared illumination emitted from immediately above and impinging and reflected on a portion other than the mark is indistinguishable from reflection light reflected by the mark, so that the position of the mark tends to be erroneously recognized. That is, it is difficult to obtain information about a state of the club head with high accuracy.

In order to prevent reflection from a portion other than the mark as described above, a black sticker may be affixed to the entire surface in the photography region of the club head 41*a* and a white circular sticker affixed on the black sticker may be detected by image processing. This method, however, is inconvenient because a relatively large black sticker needs to be affixed to the club head 41*a* and the glue on the black sticker may be left on a surface of the club head 41*a*.

On the other hand, the doughnut-shaped marks M1 and M2 of the present embodiment each include the central portion C formed with a pattern having a lightness lower than the periphery and the peripheral portion Ph formed with a pattern having a lightness higher than the central portion C. More specifically, when uniform illumination is applied in photographing the club head 41*a*, the characteristics of reflection of light from the club head 41*a* are such that reflection on a section other than the doughnut-shaped marks M1 and M2 has the highest lightness at the center of the reflection portion in the section. However, the doughnut-shaped marks M1 and M2 of the present embodiment can be clearly distinguished from the reflection portion because the lightness at the central portion C is low and the lightness of the peripheral portion Ph is high. The erroneous recognition described above therefore can be avoided, and information about a state of the club head can be obtained with high accuracy.

Furthermore, the doughnut-shaped marks M1 and M2 are convenient because they can be formed with stickers that are small relative to the size of the club head 41*a*, and glue remaining on the club head 41*a* when a large black sticker is affixed thereto can be prevented.

In theory, the two doughnut-shaped marks M1 and M2 described above can be detected from one photographic image by performing the process of detecting the doughnut-shaped marks M1 and M2. However, three or more patterns may be detected as the doughnut-shaped marks, for example, because of reflection on the club head 41*a*. A process of identifying two doughnut-shaped marks M1 and M2 in such a case will be described below.

First, the image generating unit 21 specifies the photographic images immediately before and after the club head 41*a* impacts the golf ball 42, and determines whether only two doughnut-shaped marks M1 and M2 are detected from theses photographic images.

Then, when only two doughnut-shaped marks M1 and M2 are detected from these photographic images, the image generating unit 21 calculates the heights and the widths of the detected doughnut-shaped marks M1 and M2 and the distance between the doughnut-shaped mark M1 and the doughnut-shaped mark M2.

Then, for a photographic image in which three or more patterns are detected as the doughnut-shaped marks, two patterns closest to the heights and the widths of the doughnut-shaped marks M1 and M2 described above and the distance between the doughnut-shaped mark M1 and the doughnut-shaped mark M2 are specified among three patterns, and these two patterns are detected as the doughnut-shaped marks M1 and M2.

When three or more patterns are detected in both of the photographic images immediately before and after the club head 41*a* impacts the golf ball 42, photographic images advanced one frame forward and backward sequentially from the moment of the impact are specified, and it is determined whether only two doughnut-shaped marks M1 and M2 are detected.

Generation of a group of face images by the image generating unit 21 has been described above. In addition to a group of face images, the image generating unit 21 also generates a trajectory image that represents the trajectory of the club head 41*a* by a line.

Specifically, the image generating unit 21 generates a trajectory image by extracting an image portion of the club head 41*a* from each photographic image, calculating the center portion of each of the extracted image portions of the club head 41*a*, and connecting the calculated center positions to fit a curve.

Returning now to FIG. 1, the control unit 22 includes a CPU and controls the entire golf impact analysis system 1. Specifically, the control unit 22 communicates with the photography device 10 through the communication OF and outputs a control signal to instruct the photography device 10 of a photography start timing and a frame rate of photography.

The photography start timing may be specified and input, for example, by a user using the input unit 24 that includes a mouse and a keyboard. Alternatively, the placement of the golf ball 42 at the golf ball placement position P in the photography region R may be detected, and photographing may be started in accordance with the detection signal. The placement of the golf ball 42 may be detected by using a contact sensor or an optical sensor, or by using a photographic image taken by the photography device 10. In the method of using a photographic image, for example, preliminary photographing in the photography region is performed by the photography device 10 before a swing of the golf club 41 is started. The photographic image taken by preliminary photographing is input to the control unit 22.

Then, the control unit 22 detects the placement of the golf ball 42 by detecting that an image of the golf ball 42 appears at a preset position in the photographic image. The control unit 22 starts main photographing in response to the placement of the golf ball 42 and starts photographing the club head 41*a*.

The control unit 22 also outputs a group of face images and a trajectory image generated by the image generating unit 21 to the projection device 30 and allows the projection device 30 to project the group of face images and the trajectory image on the floor.

Figure 10:
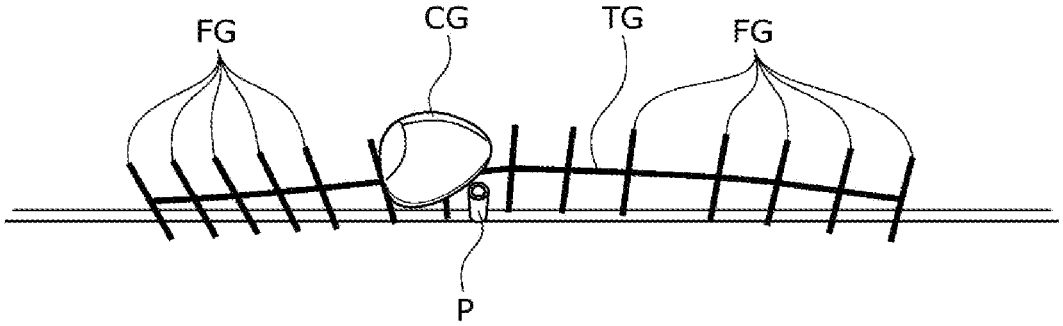
FIG. 10 is a diagram illustrating a projection display example of a group of face images and a trajectory image generated when a golf club is swung.

FIG. 10 is a diagram illustrating a projection display example of a group of face images FG and a trajectory image TG generated when the golf club 41 is swung. As illustrated in FIG. 10, for example, the projection device 30 projects a group of face images FG and a trajectory image TG on the floor. The element denoted by CG illustrated in FIG. 10 is a three-dimensional object image representing the club head.

Unlike the photographic image taken by the photography device 10, the three-dimensional object image CG is an image that schematically represents the club head as a three-dimensional image. This three-dimensional object image CG representing the club head is also generated by the image generating unit 21. Then, the control unit 22 outputs the three-dimensional object image CG to the projection device 30, and the three-dimensional object image CG is projected on the floor by the projection device 30.

FIG. 10 depicts the three-dimensional object image CG of the club head at a predetermined position on the trajectory image TG. However, the projection device 30 may display an animation of the three-dimensional object image CG moving along the line of the trajectory image TG under control by the control unit 22.

Figure 11:
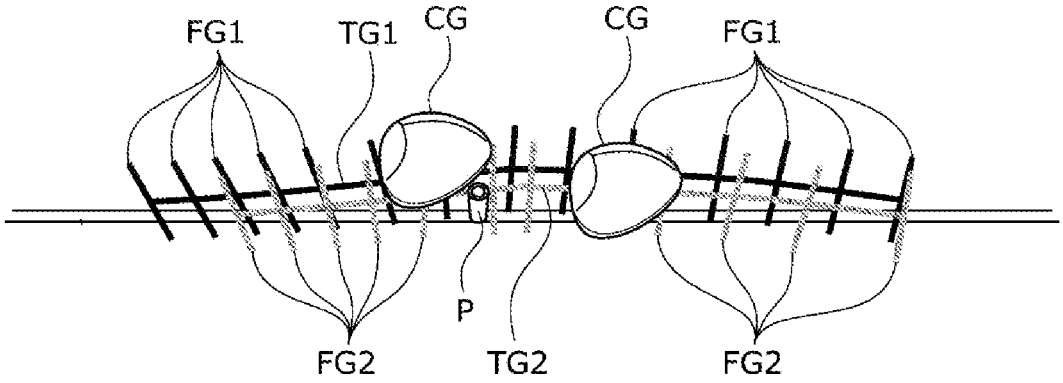
FIG. 11 is a diagram illustrating a projection display example of groups of face images and trajectory images TG generated by two swings of a golf club.

FIG. 10 illustrates an example in which a group of face images FG and a trajectory image TG in one swing is projected. However, groups of face images and trajectory images in two or more swings may be projected in an overlapped manner. FIG. 11 illustrates an example in which a set of a group of face images FG1 and a trajectory image TG1 in a first swing and a set of a group of face images FG2 and a trajectory image TG2 in a second swing are projected. It is preferable for the set of the group of face images FG1 and the trajectory image TG1 in the first swing and the set of the group of face images FG2 and the trajectory image TG2 in the second swing to be projected in different colors.

The control unit 22 also displays the group of face images and the trajectory image generated by the image generating unit 21 on the display unit 23 of the image processing device 20.

The display unit 23 includes, for example, a display device such as a liquid crystal display. The input unit 24 includes, for example, an input device such as a mouse and a keyboard. The image processing device 20 may be configured with a tablet terminal, and the display unit 23 and the input unit 24 may be configured with a touch panel.

The projection device 30 is configured with a projector and projects a group of face images and a trajectory image on the floor under the control of the control unit 22 of the image processing device 20 as described above. The projection device 30 is installed above a golfer who swings the golf club 41, or the projection device 30 is installed below the golfer and adjacent to the photography device 10 using a short-focus/proximity lens. The projection device 30 has a projection distance and brightness that enable a group of face images and a trajectory image to be displayed on the floor with sufficient lightness and clearness.

The projection device 30 is installed such that a group of face images and a trajectory image can be projected in a predetermined projection region including the vicinity around the placement position P of the golf ball 42 on the floor. The projection device 30 may be installed, for example, together with the photography device 10 on a support member such as a stand or may be installed on a ceiling.

The projection device 30 also projects a three-dimensional object image of the club head on the floor as described above.

In the foregoing embodiment, the club head 41*a* provided with the doughnut-shaped marks M1 and M2 is photographed from immediately above by the photography device 10. However, the present invention is not limited to such a configuration. For example, a stereo camera may be provided as the photography device 10, and the club head 41*a* provided with the doughnut-shaped marks M1 and M2 may be photographed stereoscopically.

In this configuration, the positions of the doughnut-shaped marks M1 and M2 in a three-dimensional space can be detected, and the motion of the club head 41*a* can be analyzed in more detail.

Figure 12:
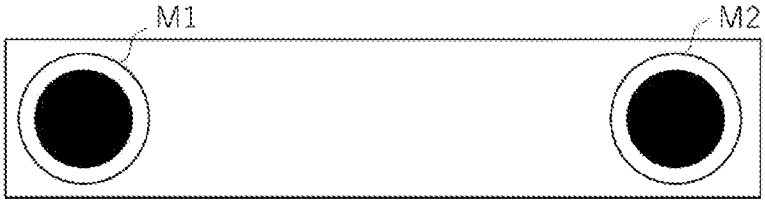
FIG. 12 is a diagram illustrating another example of the mark for club head measurement.

In the foregoing embodiment, the doughnut-shaped mark M1 and the doughnut-shaped mark M2 are formed separately. However, the present invention is not limited to such a configuration. For example, as illustrated in FIG. 12, the two doughnut-shaped marks M1 and M2 may be formed integrally by being arranged side by side on both ends of a rectangular sticker having a length equivalent to the length of the face of the club head 41*a*. In such a configuration, the rectangular sticker is affixed to the club head 41*a* such that the length direction of the rectangular sticker provided with the doughnut-shaped marks M1 and M2 is parallel to the face, whereby the direction of the face can be detected more precisely.

In the foregoing embodiment, doughnut-shaped marks are employed. However, the shape of the mark for club head measurement is not limited thereto and may be, for example, a double polygon such as a double quadrangle or triangle as long as the mark has a central portion and a peripheral portion as described above.

For example, when groups of face images and trajectory images of a plurality of golf clubs 41 are generated, the shape of the mark for club head measurement may be changed for each golf club 41. In this manner, a plurality of golf clubs 41 can be identified automatically, and the group of face images and the trajectory image can be stored and controlled for each golf club 41.

Example

Figure 13:
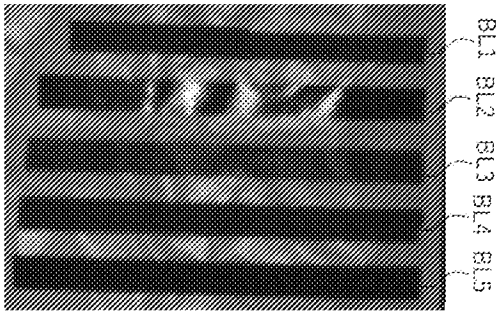
FIG. 13 is a diagram illustrating an example of a photographic image obtained by photographing five kinds of black sheets.

Examples and comparative examples of the doughnut-shaped marks M1 and M2 of the foregoing embodiment are listed in Table 1 below. Note that the present invention is not limited to these examples. Table 1 shows the measurement results of the maximum brightness value, the minimum brightness value, and the difference between the maximum brightness value and the minimum brightness value of five kinds of black sheets BL1 to BL5 used as a material for the central portion of the doughnut-shaped mark, and the detection accuracy indicated by "high" and "low" obtained when each of the black sheets BL1 to BL5 was used as the central portion of the doughnut-shaped mark. FIG. 13 illustrates a photographic image obtained by taking a photograph of five kinds of black sheets BL1 to BL5. Table 2 shows the photography conditions and the illumination conditions of five kinds of black sheets BL1 to BL5.

As illustrated in Table 1 and FIG. 13, as for Example 1 (BL4) and Example 2 (BL5), the maximum brightness value was 32 or less, and the difference between the maximum brightness value and the minimum brightness value was 15 or less. When Examples 1 and 2 were used as the central portion of the doughnut-shaped mark, high-accuracy detection was achieved.

As for Example 3 (BL1), the difference between the maximum brightness value and the minimum brightness value was 15 or less but the maximum brightness value was 35, and, therefore, when Example 3 was used as the central portion of the doughnut-shaped mark, a portion having a high brightness value was detected as noise and the detection accuracy was low.

As for Example 4 (BL2), the reflectivity was high, the maximum brightness value was 255, and the difference between the maximum brightness value and the minimum brightness value was 238 or less. When Example 4 was used as the central portion of the doughnut-shaped mark, a portion having a high brightness value and a portion with a large difference in brightness value were detected as noise, and the detection accuracy was lowest.

As for Example 5 (BL3), the maximum brightness value exceeded 32, and the difference between the maximum brightness value and the minimum brightness value exceeded 15. When Example 5 was used as the central portion of the doughnut-shaped mark, a portion having a high brightness value and a portion with a large difference in brightness value were detected as noise, and the detection accuracy was low.

TABLE 1

| | Example 1 | Example 2 | Example 3 | Example 4 | Example 5 |
|---|---|---|---|---|---|
| Black sheet | BL4 | BL5 | BL1 | BL2 | BL3 |
| Maximum brightness value | 32 | 26 | 35 | 255 | 54 |
| Minimum brightness value | 17 | 13 | 21 | 17 | 22 |
| Difference between maximum brightness value and minimum brightness value | 15 | 13 | 14 | 238 | 32 |
| Detection accuracy | High | High | Low | Low | Low |

TABLE 2

| | |
|---|---|
| Photography conditions | |
| Camera | acA640-750um made by Basler |
| Gain | 12 |
| Black level | 10 |
| Gamma | 0.8 |
| Lens | FL-CC1614A-VG made by RICOH |
| Aperture | 1.4 |
| Exposure time | 100 ms |
| Illumination conditions | |
| Light source | L760-66-60-130 (two light sources) made by Ushio Inc., power source 6 A, 20 V |
| Work distance | 3 m |

What is claimed is:

1. An image processing device comprising:

an image generating unit configured to generate a trajectory image representing a trajectory of a club head of a golf club during a swing of the golf club and a group of a plurality of face images each representing a face of the club head during the swing; and a control unit configured to display the trajectory image and the group of face images, wherein the image generating unit generates:

an image of a line along the trajectory of the club head as the trajectory image;

images that represent the face of the club head as line segments as the plurality of face images; and an image in which the image of the line as the trajectory image and the plurality of images that represent the face of the club head as line segments are overlapped, and wherein the control unit displays the image in which the image of the line as the trajectory image and the plurality of images that represent the face of the club head as line segments are overlapped.

2. The image processing device as defined in claim 1, wherein the image generating unit generates the trajectory image by extracting an image portion of the club head from each of a plurality of time-series photographic images, calculating a center position of the club head from each of the extracted image portions, and connecting the calculated center positions to fit a curve.

3. The image processing device as defined in claim 1, wherein the image generating unit detects two marks provided on a top surface of the club head at a predetermined distance from each other along a face of the club head, and generates each of the plurality of face images as a straight line connecting a center of a first one of the two marks and a center of a second one of the two marks.

4. The image processing device as defined in claim 1, wherein the control unit outputs the overlapped image to a projection device, and the projection device projects the overlapped image on a floor.

5. The image processing device as defined in claim 1, wherein the image generating unit further generates a three-dimensional object image schematically representing the club head, and the control unit displays the three-dimensional object image together with the overlapped image.

6. The image processing device as defined in claim 1, wherein the control unit displays, in an overlapped manner, a first overlapped image corresponding to a first swing of the golf club and a second overlapped image corresponding to a second swing of the golf club.

* * * * *